United States Patent [19]

Mulleneers

[11] 3,983,396

[45] Sept. 28, 1976

[54] APPARATUS FOR ADJUSTING THE FILAMENT CURRENT OF AN X-RAY TUBE

[75] Inventor: Jan Joseph Mattheus Mulleneers, Eindhoven, Netherlands

[73] Assignee: U.S. Philips Corporation, New York, N.Y.

[22] Filed: Oct. 7, 1974

[21] Appl. No.: 512,916

[30] Foreign Application Priority Data

Oct. 12, 1973 Netherlands ..... 7314036

[52] U.S. Cl. ..... 250/402; 250/421

[51] Int. Cl.[2] ..... H05G 1/34; H05G 1/30

[58] Field of Search ..... 315/94, 105, 139, 160, 315/246, 247; 313/55; 250/401, 414, 102, 409, 408, 402, 1, 75

[56] References Cited

UNITED STATES PATENTS

| | | | |
|---|---|---|---|
| 3,325,645 | 6/1967 | Splain | 250/409 |
| 3,783,287 | 1/1974 | Fulton et al. | 250/409 X |
| 3,842,280 | 10/1974 | Herrick | 250/409 X |

*Primary Examiner*—Robert Segal

*Attorney, Agent, or Firm*—Frank R. Trifari; Bernard Franzblau

[57] ABSTRACT

Filament-current supply for a high-voltage tube by summation of three components one of which is linearly dependent upon a control voltage, a second of which is linearly dependent upon the logarithm of the operating voltage and a third of which is linearly dependent on the product of the said two voltages.

14 Claims, 9 Drawing Figures

APPARATUS FOR ADJUSTING THE FILAMENT CURRENT OF AN X-RAY TUBE

The invention relates to a device which includes an electron tube operated at a high voltage, in particular an X-ray tube, and means for supplying and adjusting the filament-current supply for such a tube as a function of a control voltage.

In such a device the problem arises that various operating conditions, such as the tube voltage (which determines the hardness of the X-rays produced) and the tube current (which determines the intensity of this radiation), are to be controlled — are to be predictably adjusted — at a time when the tube is inoperative. In particular when making radiographs the patient must not be unnecessarily exposed to X-rays. In addition, the tube must not dissipate energy unnecessarily as this will involve unnecessary losses and anode burn-in. Hence short exposure times are used during which the tube is rendered operative, the exposure being terminated by switching off the tube, in particular by switching off the voltage across the tube or by reducing it to a value such that substantially no tube current flows.

If, however, no current flows through the tube, it is a problem to fix the tube current at a desired value, for example by comparison with a desired adjustment current. The present invention provides means by which, during the time in which no current flows through the tube, a filament current adjustment can be made so that as soon as the full operating voltage is switched across the tube, the desired predictable tube current starts to flow. For this purpose the invention is characterized by the provision of:

means ($I_1$) for converting a control voltage ($V_{RA}$) into a component ($a_1 V_{RA} + b_1$) which is linearly dependent on $V_{RA}$, means ($I_2$) for converting the tube voltage ($V_B$) into a component ($a_2 \log V_B + b_2$) which is linearly dependent upon the logarithm of the tube voltage, means ($I_3$) for forming a component which is proportional to the product of the deviation of the control voltage ($V_{RA}$) from a given value and of the deviation of the logarithm of the tube voltage from a given value, and means ($\epsilon$) for summing the said components so as to produce a desired value (Ieff-Soll) for the filament current supply of the tube.

Figure 1:
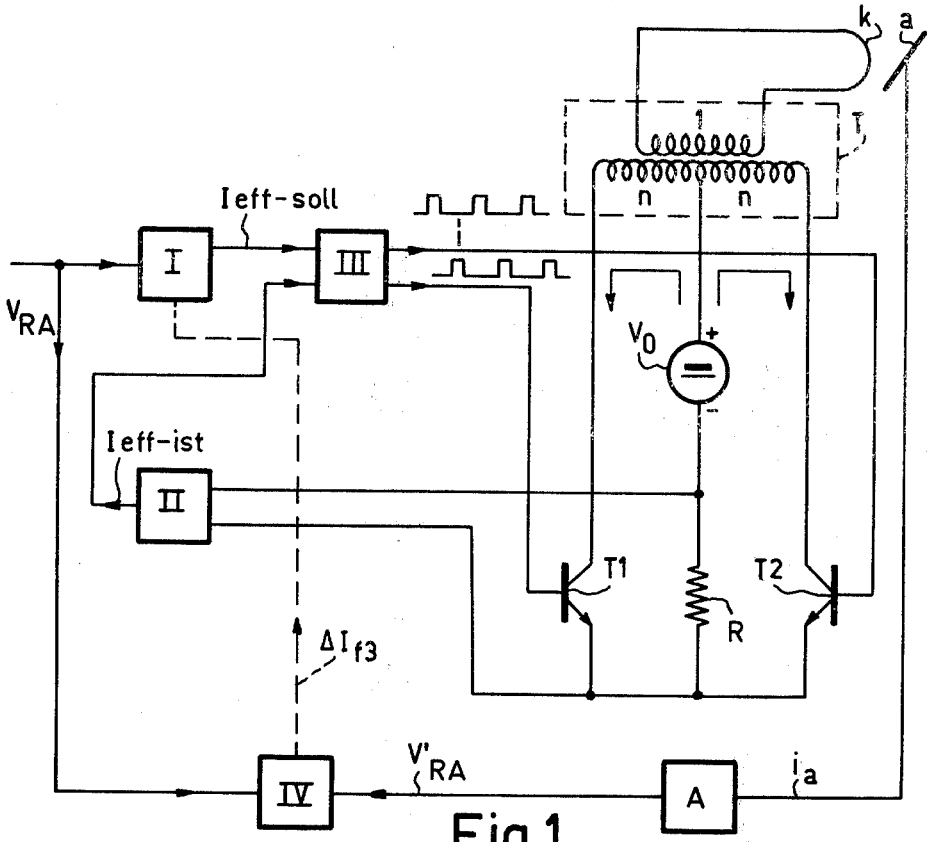
Figure 2:
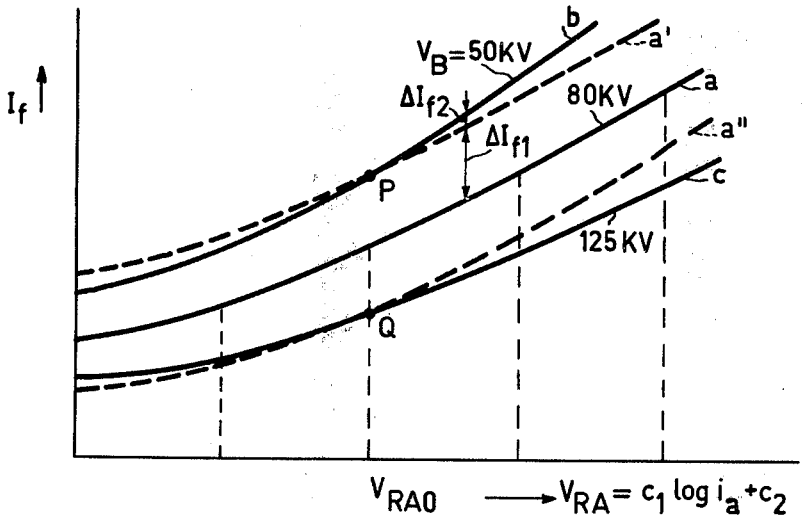
Figure 5:
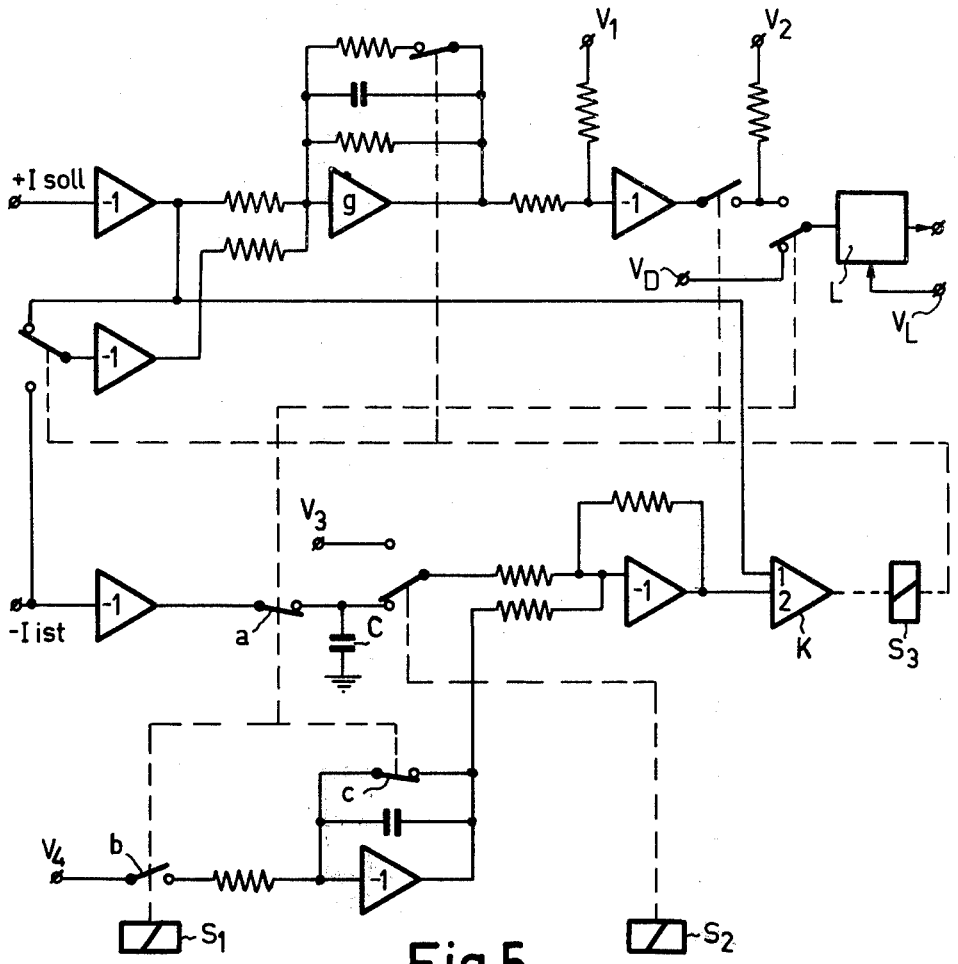
Figure 6:
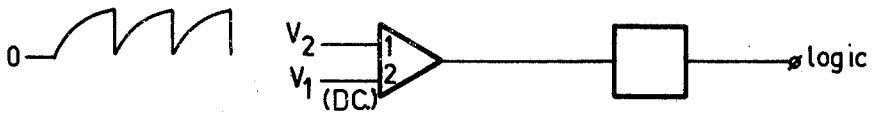
Figure 7:
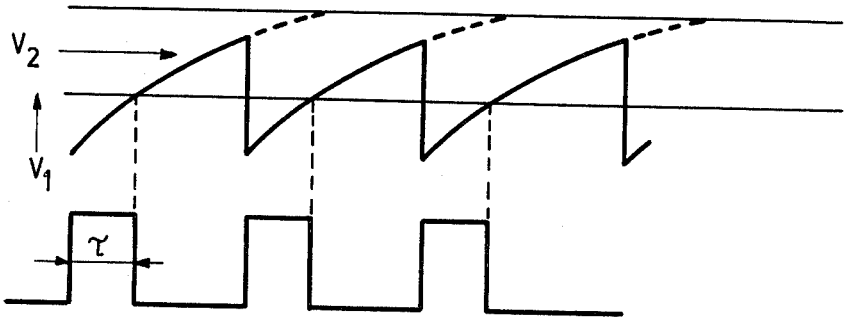
Figure 8:
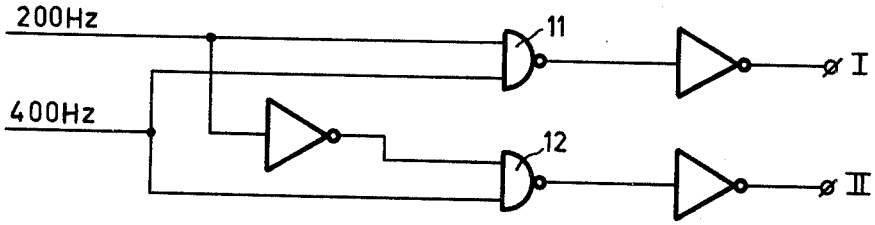
Figure 9:
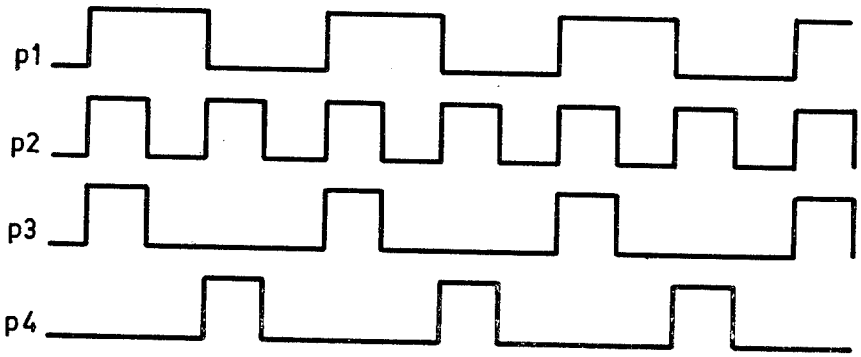

An embodiment of the invention will now be described, by way of example, with reference to the accompanying diagrammatic drawings, in which:

FIG. 1 is a circuit diagram showing schematically the basic elements of a device according to the invention, FIG. 2 is a diagram showing characteristic curves of the filament current as a function of the desired tube current, FIGS. 3, 4, 5, 6 and 8 are detail circuit diagrams of blocks shown in FIG. 1, and FIGS. 7 and 9 show voltage waveforms of signals illustrating the operation of the device according to the invention.

Referring now to FIG. 1, there are shown a cathode $k$ and an anode $a$ of an electron tube, more particularly an X-ray tube, the operating parameters of which are to be adjusted in a predictable manner in accordance with an external control signal $V_{RA}$. This control signal may be manually adjustable or may alternatively be obtained by further means, described in a co-pending U.S. patent application Ser. No. 512,920, filed Oct. 7, 1974, which respond to the values set; of the exposure time, the hardness and the intensity of the radiation to which the object, in this case the patient, is to be exposed. The assembly is controlled by means of an external control signal. This control signal, which is denoted by $V_{RA}$, is a given function of the tube current $i_a$ according to the formula:

$V_{RA} = c_1 \log i_a - c_2$; when $V_{RA}$ is expressed in volts and $i_a$ in milliamperes, $c_1$ is about 8 and $c_2$ is about 20. The control ranges may, for example, be as follows: 10 volts $< V_{RA} < +10$ volts and 20 mA $< I_a <$ 6.3A. For fluoroscopy the tube currents are smaller by a factor of 100 with corresponding $V_{RA}$ values.

The tube filament current characteristic curve of an X-ray tube shows an approximately linear relationship between the filament current $i_f$ and the logarithm of the tube current $i_a$ with the tube voltage as a parameter. If a control signal proportional to the logarithm of the tube current is available, a voltage may be generated in a function generator which provides the filament current $i_f$ for the desired tube current $i_a$.

The diagram of FIG. 2 shows curves ($a$, $b$, and $c$) which represent the function $i_f = f(\log. i_a)$.

Technical realisation of the said function generator starts from the curve $a$. This curve is divided into sections which are then approximated to in a linear manner. Thus each section requires separate adjustment. The curve found is correct only at a fixed tube voltage (for the time being a value of 80 kV has been chosen).

If the tube voltage $V_B$ is higher or lower, a smaller or a larger filament current respectively has to be produced to obtain equal tube currents.

However, the value by which the curve $a$ is to be corrected is also dependent upon the tube current. With small tube currents smaller corrections will have to be made as a function of the tube voltage than will be the case with large tube currents.

Initially, with a fixed value of $V_{RA}$ the curve $a$ is corrected by a value $\Delta If_1$ for the tube voltages 50 kV (curve $a'$) and 125 kV (curve $a''$).

These curves are parallel to the initial curve $a$. To obtain the desired curves $b$ and $c$ another operation is performed which provides a third coefficient $\Delta If_2$, with the result that the broken-line curves $a'$ and $a''$ are rotated about points P and Q respectively to give the curves $b$ and $c$.

This correction coefficient is provided by a multiplier, more particularly a four-quadrant multiplier, which delivers a voltage which is linearly dependent upon the logarithm of the tube voltage $V_B$.

The correction $\Delta If_2$ is zero for $V_{RA} = V_{RAO}$ and/or for $V_B = 80$ kV (curve $a$). For other values the sign of $\Delta If_2$ can be read directly from the Figure.

A filament current transformer T for the cathode $k$ has a centre tapping on the primary. Through switching transistors $T_1$ and $T_2$ a direct voltage $V_0$ is alternately set up across either half of the primary winding. The pulse trains, which for this purpose are applied to the bases of these transistors, are relatively shifted in phase by 180°. By varying the pule width the effective value of the filament current can be regulated.

The pulse duration is determined in a circuit (block III) in which the desired and actual or measured values of the filament current $i_f$, which are applied to the inputs, are compared.

In normal operation the pulse duration will be corrected until the difference voltage at the input of the block III is substantially zero volts.

The value of $I_{eff\text{-}soll}$ (desired value) is produced in a function generator (block I) which, on reception of a given DC input signal $V_{RA}$ selects the corresponding value of $I_{eff\text{-}soll}$.

In the block II the value of $I_{eff\text{-}ist}$ (actual value) is determined from the signal measured across a resistor R included in the primary filament current circuit.

At a given value of the control voltage $V_{RA}$ the tube current $i_a$ is to be fixed in accordance with the formula: $V_{RA} = c_1 \log i_a - c_2$.

Figure 3:
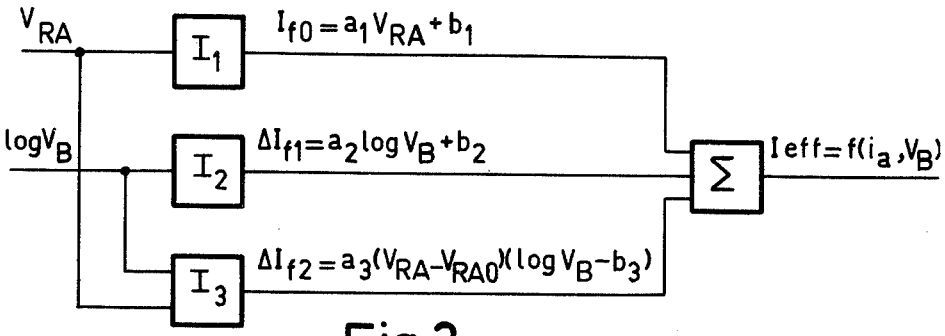

The block I comprises a circuit shown schematically in FIG. 3. The external control signal $V_{RA}$ is applied to a linear stage $I_1$ which converts $V_{RA}$ into $I_{f0} = a_1 . V_{RA} + b_1$ and also to a multiplier stage $I_3$ in which $V_{RA}$ is multiplied by $\log V_B$ according to the four-quadrant multiplication: $\Delta I_{f2} = a_3 (V_{RA} - V_{RAO})$ times $(\log V_B - b_3)$. From the tube voltage $V_B$ a signal proportional to $\log V_B$ is derived which is applied not only to the said stage $I_3$ but also to a linear stage $I_2$ which delivers a current $\Delta I_{f1} = a_2 . \log V_B + b_2$. In a summation stage $\Delta$ the three resulting currents $I_{f0}$, $\Delta I_{f1}$ and $\Delta I_{f2}$ are added so that the resulting signal $I_{eff}$ is in the desired functional relationship with $V_{RA}$. It then is to be expected that the tube current $i_a$ which flows during exposure (that is to say, with the tube voltage $V_B$ switched into circuit) exactly follows the equality $V_{RA} = c_1 \log i_a - c_2$. If in practice there still should be a deviation from this equality, it may be corrected as follows.

By measuring the tube current $i_a$ (in an external unit A), converting it into a $V'_{RA}$ value according to the formula $V'_{RA} = C1 . \log i_a - c_2$ and applying the resulting value to be differential amplifier in a block IV, a current $DI_{f3}$ is obtained which is degeneratively fed back to the summation stage $\epsilon$ of the block I. The block IV further includes an (electronic) switch which passes the current $DI_{f3}$ to the summation stage $\epsilon$ only if the full strength of the tube voltage $V_B$ is switched into the circuit.

Figure 4:
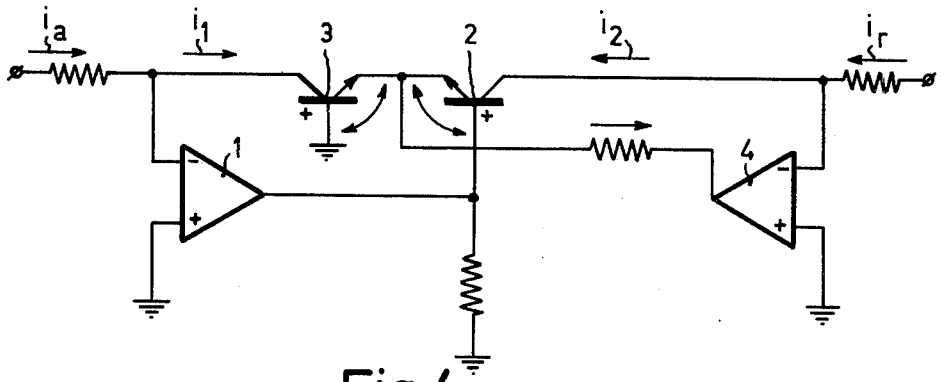

The unit A may be in the form of the circuit shown in FIG. 4. The circuit is based on the property of transistors (and diodes) that the logarithm of the current is proportional to the base-emitter voltage according to the formula:

$$U_D = \frac{kT}{q} \ln \frac{i_1}{i_0}$$

The incoming current $i_a$ is supplied to an operational amplifier 1 the output of which is connected to the base of a first transistor 2. This transistor is connected, in series with a transistor 3, between a terminal to which the current $i_a$ is supplied and a terminal to which a reference current $i_r$ is supplied. The reference current also is supplied to the input of an operational amplifier 4. The output of the latter amplifier is connected to the interconnected emitters of the transistors 2 and 3 so that a negative feedback loop is formed which causes the current $i_1$ to be substantially equal to the current $i_a$ and the current $i_2$ to be substantially equal to the current $i_r$. For a voltage $e_1 = U_{D2} - U_{D3}$ we now have $$e_1 = \frac{kT}{q} \ln \frac{i_a}{i_r}$$

so that a proper choice of $i_r$ enables the desired value of $e_1$ to be set.

The block II of FIG. 1 may take the form of a digital-to-analog converter of conventional configuration. It delivers a DC signal $I_{eff\text{-}ist}$ the value of which corresponds to the effective value of the current pulses flowing through the resistor R.

The differential amplifier III delivers a direct voltage whis is a measure of the difference between the applied value of $IF_{soll}$ and the value of $IF_{ist}$ given by the measuring system.

The said direct voltage is applied to a pulse duration modulator which will be described hereinafter with refernce to FIG. 6. At the output of this circuit two pulse trains are delivered at a fixed frequency of, say, 200 Hz, which are mutually shifted in phase by 180° (FIG. 9).

The duration of the pulses depends upon the direct voltage applied to the pulse modulator.

The said pulse trains control the switching transistors $T_1$ and $T_2$ connected in the primary circuit of the filament-current transformer.

In this circuit the effective value of the filament current is measured again so that the control loop is closed. When a readiness command is used the control loop is closed after a given time only.

The latter feature is included to enable the final stage to be fully driven so that the filament of the X-ray tube is a more rapidly raised to the operating temperature (boosting).

This is because the regulating system only considers the effective value of the filament current and does not consider the temperature of the cathode.

FIG. 5 is a circuit diagram showing schematically the basic elements of the said circuit. The time during which, after the readiness command, the regulating circuit is not yet closed is determined in the boost circuit.

In the inoperative condition relays $S_1$ and $S_3$ are de-energized. Two voltages are applied to a comparator K. The voltage at the comparator input 1 is equal to $-I_{soll}$. In the inoperative condition, either $-I_{ist}$ or $V_3$ is applied to the input 2. $V_3$ is a voltage which corresponds with the preheating current of the foci.

If fluoroscopy always is performed with small focus and the apparatus then is switched to radiography with large focus, then at the readiness command $If_{ist}$ is equal to the filament current which supplies the small focus. However, this value should not be applied to the comparator input.

A voltage is to be applied which corresponds to the filament current which at the readiness command flows through the radiography focus (= $V_3$).

In the case of fluoroscopy and radiography with the same focus a relay $S_2$ is not energized. But in this case $If_{ist}$ is the filament current which flows through the radiography focus at the readiness command.

As soon as relay $S_1$ is energized, the $If_{ist}$ value is stored in a capacitor C (contact *a* opens). At the same time an integrator starts via contacts *b* and *c* so that a linearly rising voltage is applied to the input 2 of the comparator.

As soon as this voltage exceeds the voltage $If_{soll}$, the comparator K flips over, the relay $S_3$ is energized and the regulating loop is closed.

Thus the boost time depends upon:

a. the filament current which passed the radiography focus during readiness-start (history), b. the filament current required for radiography.

As long as the relay $S_3$ has not yet closed after the readiness command, a voltage $V_2$ is applied to the input of a limiter L. As a result, the modulator delivers a pulse train of maximum pulse duration so that the filament current is raised to a maximum.

The limiter has the task of limiting the output voltage to the modulator to a value less than $V_L$ to prevent the modulator from delivering pulse trains the pulse duration of which should exceed the value of 2 ms. Varying $V_L$ even permits of limiting the pulse durations to values less than 2 ms. Thus $V_L$ is an adjustment which enables the maximum pulse duration and hence the maximum filament current to be selected.

The pulse duration circuit is shown in FIG. 6. In this circuit the direct voltage $V_1$ produced by the differential amplifier is compared in a comparator to a pulsatory voltage having a fixed frequency and shape ($V_2$).

To an input 1 of the comparator is applied an exponential voltage (FIG. 7) which is reset at a fixed frequency of, say, 400 Hz.

The pulse duration $\tau$ is dependent upon the value of the voltage $V_1$ according to the formula $$\tau = RC \ln \frac{V_2}{V_2 - V_1}$$

The effective value of the filament current is approximately proportional to the square root of $\tau$ according to the ratio $dI_{eff} : d\tau = 1 : \sqrt{\tau}$. At small pulse durations $$\frac{dI_{eff}}{d\tau}$$

is a maximum. In the pulse duration modulator, $$\frac{d\tau}{dV_1}$$

is a minimum at small pulse durations.

By means of calculations the RC generator is proportioned so that the dynamic transfer function between $V_1$ and $I_{eff}$ is approximately constant for any $I_{eff}$.

This provides the advantage that in the circuit of the regulating loop only a single value of the transfer function $I_{eff} = f(V_1)$ need be taken into account.

After the comparator the pulse is converted to a level suitable for logic.

The 400 Hz pulse from the pulse duration modulator is applied to a circuit as shown in FIG. 8.

On one line of this circuit there is a symmetrical 200 Hz square-wave pulse which is in phase with the 400 Hz pulse train on the other line (FIG. 9).

Because the inverter at one of the inputs of a NAND-gate 12 inverts the 200 Hz input signal, an output pulse $p_4$ will be shifted in phase by 180° relative to an output pulse $p_3$. The pulse trains $p_3$ and $p_4$ are applied to the switching transistors $T_1$ and $T_2$ of the primary circuit of the filament current transformer.

What is claimed is:

1. Apparatus for adjusting the filament current supply for an x-ray tube as a function of a control voltage $V_{RA}$ comprising, means responsive to the control voltage for converting said control voltage into a first signal component of the form $a_1 V_{RA} + b_1$ which is linearly dependent upon $V_{RA}$ and wherein $a_1$ and $b_1$ are constants, means for converting the x-ray tube operating voltage $V_B$ into a second signal component of the form $a_2 \log V_B + b_2$ which is linearly dependent upon the logarithm of the operating voltage and wherein $a_2$ and $b_2$ are constants, means responsive to the control voltage and to a voltage proportional to the logarithm of the tube operating voltage for combining said voltage to produce a third signal component proportional to the product of the deviation of the control voltage from a given value of the control voltage and of the deviation of the logarithm of the tube operating voltage from a given value of the operating voltage, and means responsive to said first, second and third signal components for summing said signal components to produce an output signal indicative of the desired value of the filament current supply for the x-ray tube.

2. Apparatus as claimed in claim 1 further comprising means responsive to the x-ray tube operating current for converting said operating current into a second control voltage which is linearly dependent upon the logarithm of said operating current, and means for comparing the second control voltage with the first control voltage to produce a further signal correction component of said output signal.

3. Apparatus as claimed in claim 2 further comprising comparison means having first and second inputs connected to receive said output signal and a voltage proportional to the actual filament current, and a pulse width modulator coupled to the output of the comparison means for deriving width modulated current pulses for the filament of the x-ray tube and controlled by the output of the comparison means.

4. Apparatus as claimed in claim 1 further comprising a comparator having first and second inputs which receive said output signal and a voltage proportional to the actual filament current of the x-ray tube, and means including the output of the comparator for controlling a pulse duration modulator which supplies width modulated current pulses to the filament of the x-ray tube.

5. A filament current supply for an x-ray tube comprising, a function generator responsive to first and second control voltages related to the logarithm of the tube operating current and the logarithm of the tube operating voltage, respectively, and including means for combining said first and second control voltages to derive a first output signal indicative of the desired value of the tube filament current, means responsive to the actual filament current to derive a second output signal determined thereby, and comparison means responsive to said first and second output signals for deriving a third output signal for controlling the amplitude of the tube filament current.

6. A filament current supply as claimed in claim 5 wherein said function generator combining means comprises, means responsive to the first control voltage for deriving a first signal component that is linearly dependent on said first control voltage, means responsive to the second control voltage for deriving a second signal component that is linearly dependent on the logarithm of the tube operating voltage, means for multiplying said first and second control voltages to derive a third signal component, and means for summing said first, second and third signal components to derive said first output signal.

7. A filament current supply as claimed in claim 6 further comprising means for supplying to an input terminal of the function generator said first control voltage which is of the form $c_1 \log i_a - c_2$ wherein $i_a$ is the tube operating current and $c_1$ and $c_2$ are constants.

8. A filament current supply as claimed in claim 6 further comprising means responsive to the tube operating current for deriving a third control voltage linearly dependent upon the logarithm of the operating current, and means for comparing said first and third control voltages to derive a further signal component which is degeneratively fed back to the summing means of the function generator.

9. A filament current supply circuit as claimed in claim 6 wherein said comparison means further comprises means responsive to the first and second output signals for deriving a first control signal determined by the difference thereof and a pulse width modulator including a differential amplifier having first and second inputs, means for supplying the first control signal to said first input and a periodic signal to the second input thereby to produce pulse width modulated signal pulses at the output of said modulator.

10. A filament current supply circuit as claimed in claim 5 further comprising means responsive to the tube operating current for deriving a third control voltage linearly dependent upon the logarithm of the operating current, and means for comparing said first and third control voltages to derive a further signal component which is applied to an input of the function generator to correct said first output signal.

11. A filament current supply circuit as claimed in claim 5 wherein said function generator combining means comprises, means responsive to the first control voltage for deriving a first signal component of the form $a_1 V_{RA} + b_1$ wherein $a_1$ and $b_1$ are constants and $V_{RA}$ is the first control voltage, means responsive to the second control voltage for deriving a second signal component of the form $a_2 \log V_B + b_2$ wherein $a_2$ and $b_2$ are constants and $V_B$ is the tube operating voltage, means for multiplying said first and second control voltages to derive a third signal component, and means for summing said first, second and third signal components to derive said first output signal.

12. In an x-ray tube filament current supply of the type having a filament current transformer and means for controlling the flow of current in the transformers, the improvement comprising means for adjusting the tube filament current to a desired value prior to the application of the normal operating voltage $V_B$ across the x-ray tube, said adjusting means comprising, a first input terminal for a first control voltage, a second input terminal for a second control voltage determined by the tube operatinng voltage $V_B$, function generator means coupled to said first and second input terminals and responsive to the first and second control voltages to derive at its output a first output signal indicative of the desired value of the tube filament current, said function generator means comprising, means responsive to the first control voltage for deriving a first signal component dependent thereon, means responsive to the second control voltage for deriving a second signal component dependent on the logarithm of the tube voltage $V_B$, means for combining said first and second control voltages to derive a third signal component, and means for summing said first, second and third signal components to derive said first input signal at the output of the function generator means, said current controlling means being responsive to said first output signal to adjust the flow of current in the filament transformer to obtain the desired value of tube filament current prior to the application of the operating voltage $V_B$ to the x-ray tube.

13. A filament current supply as claimed in claim 12 wherein said current controlling means comprises, means responsive to the flow of filament current in said transformer prior to the application of the tube operating voltage $V_B$ to derive a second output signal determined thereby, and comparison means responsive to said first and second input signals for deriving a third output signal for controlling the flow of current in the filament transformer in a manner tending to reduce the difference signal at the input of the comparison means to zero.

14. A filament current supply as claimed in claim 13 further comprising means responsive to the flow of tube operating current subsequent to the application of the tube operating voltage $V_B$ for deriving a third control voltage dependent upon the logarithm of the operating current, and means for comparing said first and third control voltages to derive a further signal component which is degeneratively fed back to the summing means of the function generator means to correct said first output signal.

* * * * *